US005873940A

United States Patent [19]

Takahashi et al.

[11] Patent Number: 5,873,940

[45] Date of Patent: Feb. 23, 1999

[54] COATING APPARATUS HAVING AN ADJUSTABLE HEAD WITH MOVABLE ADJUSTING DEVICES

[75] Inventors: Susumu Takahashi; Shigeji Mori; Hisakazu Kawai, all of Osaka, Japan

[73] Assignee: Inoue Kinzoku Kogyo, Co., Ltd., Osaka, Japan

[21] Appl. No.: 834,600

[22] Filed: Apr. 7, 1997

Related U.S. Application Data

[63] Continuation of Ser. No. 466,987, Jun. 6, 1995, abandoned.

[30] Foreign Application Priority Data

Feb. 10, 1995 [JP] Japan ..... 7-059638

[51] Int. Cl.[6] ..... B05C 5/00

[52] U.S. Cl. ..... 118/410; 118/413; 118/416; 118/419; 425/466

[58] Field of Search ..... 118/409, 410, 118/413, 416, 419; 425/465, 466, 141; 427/356

[56] References Cited

U.S. PATENT DOCUMENTS

| | | | |
|---|---|---|---|
| 2,387,718 | 10/1945 | Coleman | 425/466 |
| 2,718,661 | 9/1955 | Russell | 425/466 |
| 2,865,048 | 12/1958 | Hudson | 425/466 |
| 3,039,143 | 6/1962 | Nicholson | 425/466 |
| 3,080,608 | 3/1963 | Van Riper | 425/382.4 |
| 3,096,543 | 7/1963 | Konopacke | 425/466 |
| 3,940,221 | 2/1976 | Nissel | 425/141 |
| 4,067,655 | 1/1978 | Mayerhofer | 403/4 |
| 4,514,348 | 4/1985 | Iguchi et al. | 425/466 |
| 4,726,752 | 2/1988 | VanDun | 425/141 |
| 4,852,514 | 8/1989 | Wohrle | 118/410 |
| 4,854,844 | 8/1989 | Carlsen | 425/466 |
| 5,067,432 | 11/1991 | Lippert | 118/413 |
| 5,423,668 | 6/1995 | Cloeren | 425/466 |

OTHER PUBLICATIONS

Patent Abstract of Japan Publication No. 02152574A, Jun. 12, 1990.

Patent Abstract of Japan Publication No. 02172555A, Jul. 4, 1990.

Patent Abstract of Japan Publication No. 02172556A, Jul. 4, 1990.

*Primary Examiner*—Laura Edwards

*Attorney, Agent, or Firm*—Wenderoth, Lind & Ponack, L.L.P.

[57] ABSTRACT

A coating apparatus comprises a head (25) having opposite edges (6, 7) cooperating with each other to provide an outlet (4*a*) of a coating liquid supply slit (4), and opposing portions (23*a*, 23*b*) between which a longitudinal recess (28) is formed, and a plurality of adjusting devices (30) having opposite ends (31, 32) engaged with the opposing portions of the head. A pulling or compressive force is developed between the opposite ends of each adjusting device so as to adjust the clearance (D) of the opposite edges. The adjusting means are movable in the longitudinal direction of the apparatus with their ends being engaged with the opposing portions of the head.

3 Claims, 9 Drawing Sheets

COATING APPARATUS HAVING AN ADJUSTABLE HEAD WITH MOVABLE ADJUSTING DEVICES

This application is a of now abandoned application, Ser. No. 08/466,987, filed on Jun. 6, 1995.

BACKGROUND OF THE INVENTION

1. Field of the Invention

The present invention relates to an improvement in a coating apparatus which can adjust the clearance between edges or between the edge and a web or object.

2. Description of the Related Art

FIG. 8 is a left side view, partly in section, of a conventional coating apparatus wherein the clearance between two confronting edges is adjustable. FIG. 9 is a partial front view, on a reduced scale, of the coating apparatus shown in FIG. 8. Referring to FIG. 8, a coating apparatus 1 comprises a split head 5 composed of a first head section 2 and a second head section 3 and including a coating liquid supply slit 4 defined between the first and second head sections 2 and 3 and extending in a longitudinal direction (shown by the arrow A in FIG. 9), a pair of edges 6 and 7 arranged on the top of the head 5 in a confronting relationship and cooperating to form an outlet 4*a* of the slit 4, a longitudinal recess 8 defined between opposing sides (or portions) 3*a* and 3*b* of the second head section 3, and a plurality of adjusting means 10 extending between the opposite sides 3*a* and 3*b* of the second head section 3. As shown in FIG. 9, the adjusting means are longitudinally arranged at a fixed interval P.

The edges 6 and 7 may be discrete members. In such a case, the edges 6 and 7 are bolted to the first and second head sections 2 and 3.

Each of the adjusting means 10 comprises a bolt 11 threaded into the side 3*a* of the second head section 3, a nut 12 threaded on the bolt 11, and a locking member 13 for locking the nut 12 against the side 3*b* of the second head section 3. The bolt 11 has a front thread 11*a* and a rear thread 11*b*. The front thread 11*a* and the rear thread 11*b* are different in pitch from each other. Thus, the bolts 11 is in the form of a differential screw and enables fine adjustment. When the bolt 11 is rotated, a pulling or compressive force is developed between the front thread 11*a* of the bolt 11 and the locking member 13. The edge 7 is deformed under these forces so as to adjust a narrow clearance D of the outlet 4*a* in the order of a few microns to a few hundred microns.

With the coating apparatus 1, a coating liquid is applied from the outlet 4*a* of the slit 4 onto a web W of paper Ior plastic film, as supplied from a back-up roll B, so as to form a coating layer C. The thickness of the coating layer C in the longitudinal direction depends on a clearance D. Thus, it is imperative to adjust the clearance D of the outlet 4*a* in the longitudinal direction (shown by the arrow A).

The coating apparatus 1 may perform a post-coating metering method wherein the amount of a coating liquid as applied from the outlet 4*a* to the web W is measured before the coating layer C is deposited on the web W. In such a case, the clearance D of the outlet 4*a* should be widened, for example, about 3.0 to 20.0 mm. The thickness of the coating layer C in the longitudinal direction depends on the longitudinal clearance E formed between the web W and the edge 7. To this end, the bolts 11 of the adjusting means 10 are rotated to deform the edge 7 so as to adjust the clearance E between the web W and the edge 7.

The clearance D of the outlet 4*a* and the clearance E between the web W and the edge 7 vary depending upon not only one condition, but various conditions, for example, how accurately the edge 7 is machined, how firmly the edge 7 is connected to the head 7, and how high the temperature of a coating liquid is. Thus, it is impossible to determine which portions of the apparatus require adjustment. In the prior art coating apparatus, the distance P between adjacent adjusting means 10 and 10 is minimized to enhance the accuracy of adjustment.

Such an arrangement requires a large number of adjusting means 10 arranged along the length of the apparatus. However, some of the adjusting means 10 may be useless if they are mounted to portions where no adjustment is necessary. Adjustment becomes more difficult as the number of adjusting means increases. It is also difficult to adjust portions between adjacent adjusting means 10 and 10.

In order to overcome the foregoing problems, it is an object of the present invention to provide a coating apparatus wherein the location of adjustment can be freely changed in the longitudinal direction of the apparatus.

SUMMARY OF THE INVENTION

According to a first feature of the present invention, there is provided a coating apparatus which comprises a head having edges and opposing portions between which a longitudinal recess is formed, a plurality of adjusting means each having opposite ends which are engaged with the opposing portions of the head, whereby a pulling or compressive force is developed between the opposite ends of each of said adjusting means to adjust the extent of deformation of the edge, characterized in that the adjusting means are movable in a longitudinal direction with the opposite ends of the adjusting means being engaged with the opposing portions of the head.

The adjusting means are movable in the longitudinal direction while the opposite ends of the adjusting means are engaged with the opposing portions of the head. Thus, a required number of adjusting means can be arranged at any desired locations where it is necessary to adjust the extent of deformation of the edges.

According to a second feature of the present invention, there is provided a coating apparatus which comprises a head having opposite edges adapted to cooperate with each other to provide an outlet of a coating liquid supply slit, and opposing portions between which a longitudinal recess is formed, and a plurality of adjusting means each having opposite ends engaged with the opposing portions of the head, whereby a pulling or compressive force is developed between the opposite ends of the adjusting means so as to adjust a clearance between the edges, characterized in that the adjusting means are movable in a longitudinal direction with the opposite ends of the adjusting means being engaged with the opposing portions of the head.

The adjusting means are movable in the longitudinal direction while the opposite ends of the adjusting means are engaged with the opposing portions of the head. Thus, a required number of adjusting means can be arranged at any desired locations where it is necessary to adjust the clearance between the edges.

According to a third feature of the present invention, there is provided a coating apparatus which comprises a back-up roll having an outer peripheral surface, a head having edges between which an outlet of a coating liquid supply slit is formed, and opposing portions between which a longitudinal recess is formed, and a plurality of adjusting means each having opposite ends engaged with the opposing portions of the head, whereby a pulling or compressive force is developed between the opposite ends of the adjusting means so as to adjust a clearance between the outer peripheral surface of the back-up roll and the edges, characterized in that the adjusting means are movable in a longitudinal direction with the opposite ends of the adjusting means being engaged with the opposing portions of the head.

The adjusting means are movable in the longitudinal direction while the opposite ends of the adjusting means are engaged with the opposing portions of the head. Thus, a required number of adjusting means can be arranged at any desired locations where it is necessary to adjust the clearance between the outer peripheral surface of the back-up roll and the edges.

According to a fourth feature of the present invention, there is provided a coating apparatus which comprises a back-up roll having an outer peripheral surface, a head having edges and opposing portions between which a recess is formed and extends longitudinally of the back-up roll, and a plurality of adjusting means each having opposite ends engaged with the opposing portions of the head, whereby a pulling or compressive force is developed between the opposite ends of the adjusting means so as to adjust a clearance between the outer peripheral surface of the back-up roll and the edges, characterized in that the adjusting means are movable in a longitudinal direction with the opposite ends of the adjusting means being engaged with the opposing portions of the head.

The adjusting means are movable in the longitudinal direction while the opposite ends of the adjusting means are engaged with the opposing portions of the head. Thus, a required number of adjusting means can be arranged at any desired locations where it is necessary to adjust the clearance between the outer peripheral surface of the back-up roll and the edges.

BRIEF DESCRIPTION OF THE DRAWINGS

The present invention will now be described by way of example with reference to the accompanying drawings, in which.

DESCRIPTION OF THE PREFERRED EMBODIMENTS (First embodiment)

Figure 1:
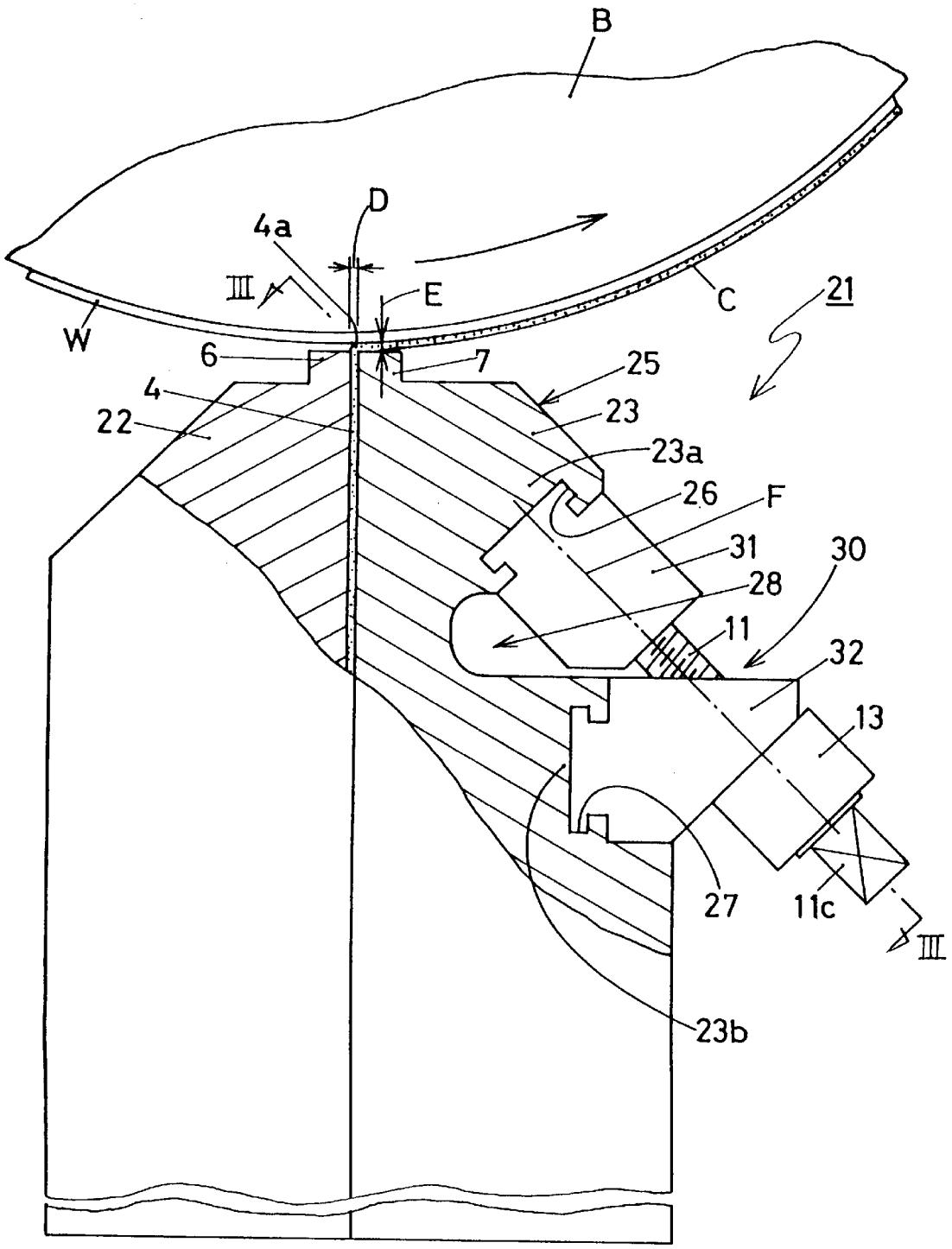
FIG. 1 is a side view of a coating apparatus according to a first embodiment of the present invention with part sectioned to show the outer appearance of adjusting means.
Figure 2:
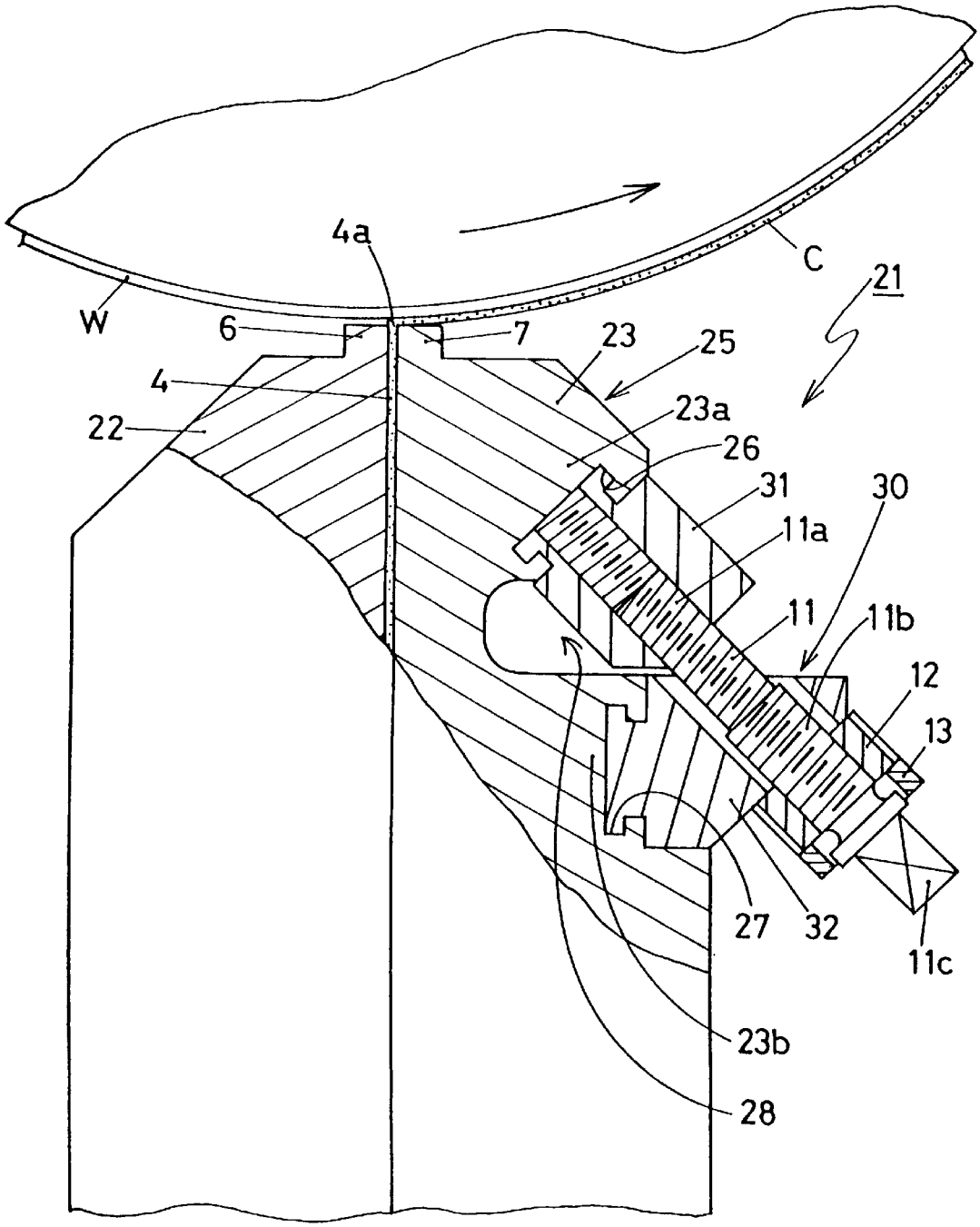
FIG. 2 is a view similar to FIG. 1, but with adjusting means shown in section.
Figure 3:
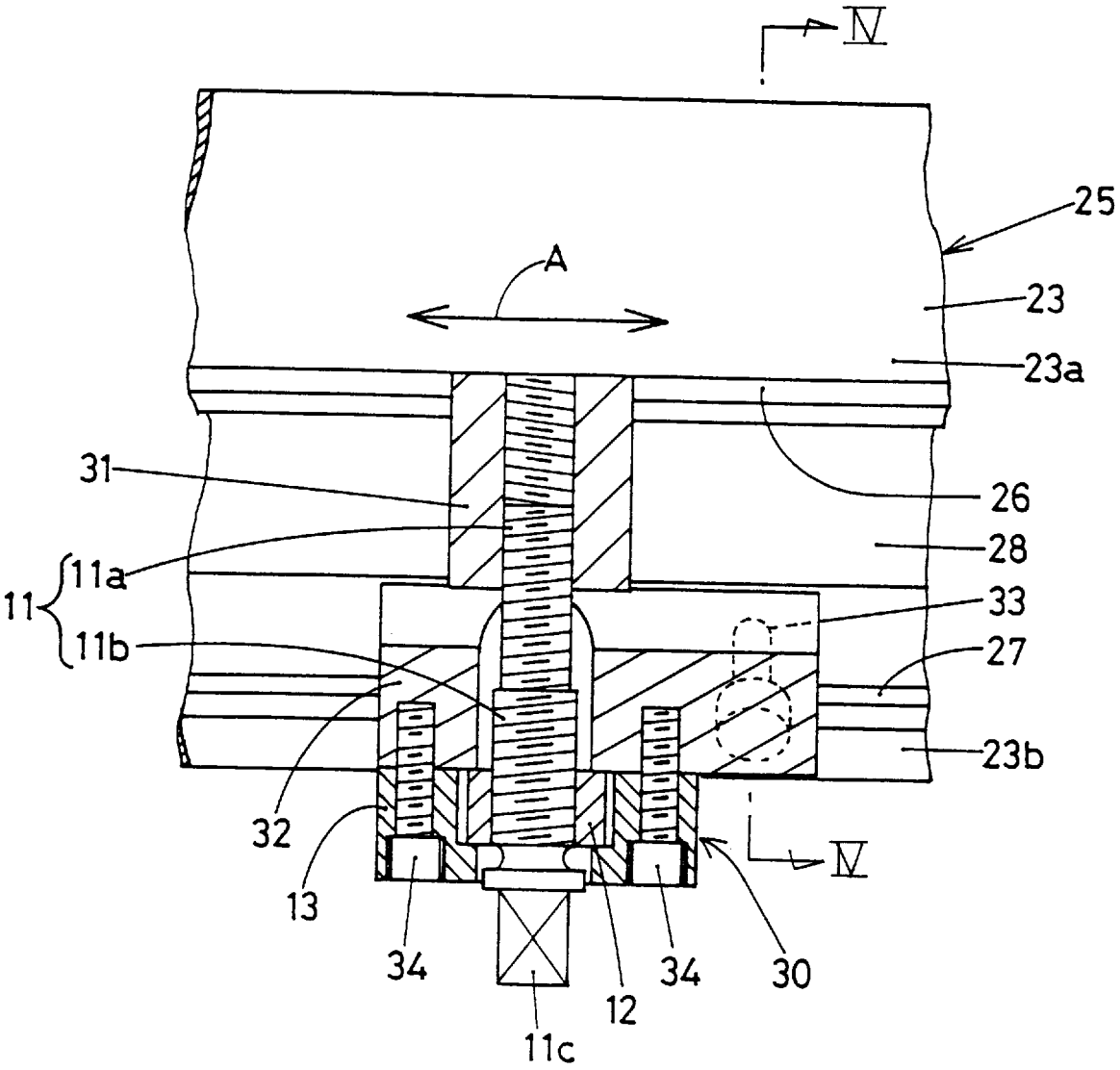
FIG. 3 is a sectional view taken on the line III—III of FIG. 1.
Figure 4:
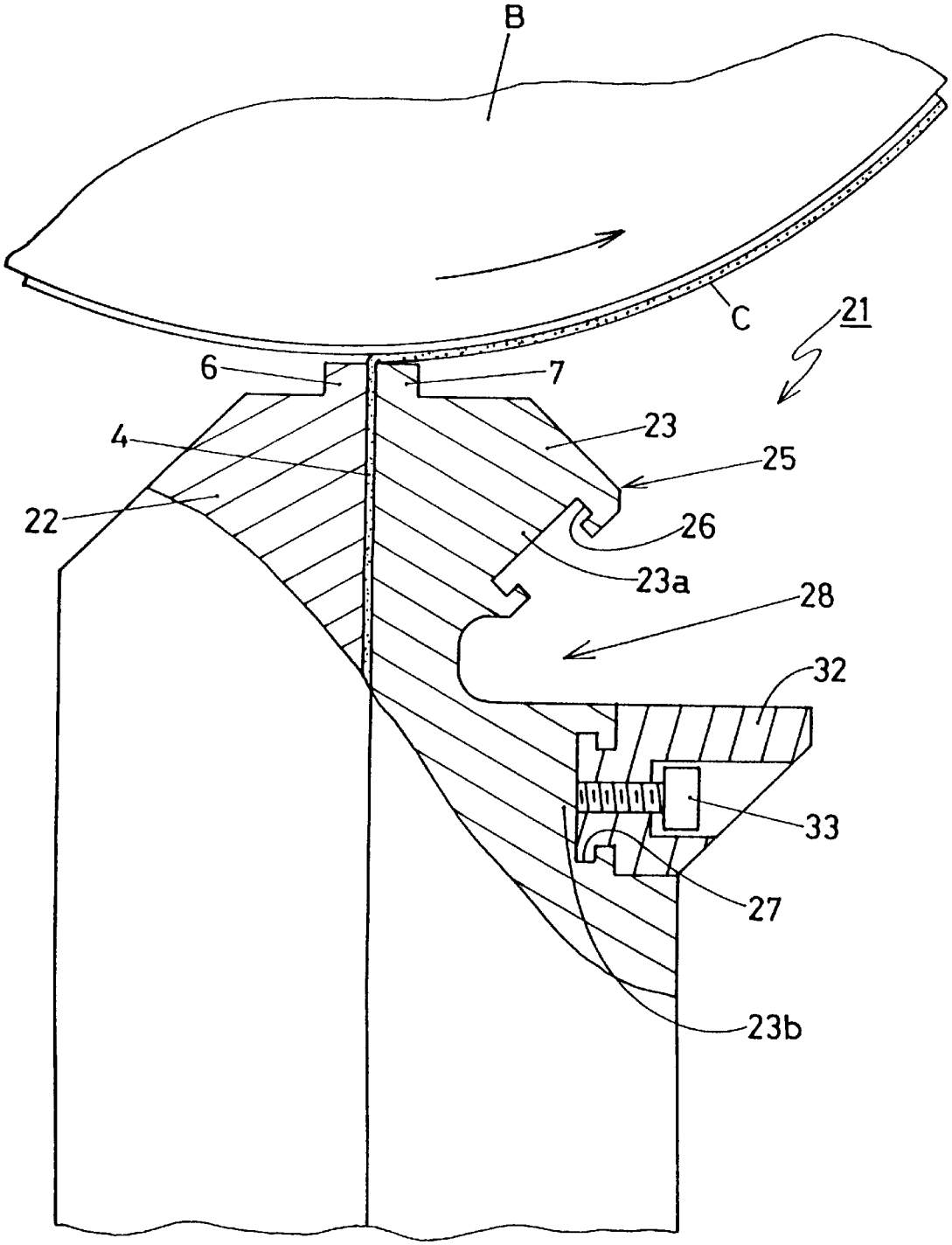
FIG. 4 is a sectional view taken on the line IV—IV of FIG. 3.

FIGS. 1 to 4 show a coating apparatus according to a first embodiment of the present invention. FIG. 1 is a side view of the coating apparatus with part sectioned to shown the outer appearance of adjusting means. FIG. 2 is a view similar to FIG. 1, but with the adjusting means shown in section. FIG. 3 is a sectional view taken on the line III—III of FIG. 1. FIG. 4 is a sectional view taken on the line IV—IV of FIG. 3.

A coating apparatus 21 according to the first embodiment comprises a split head 25 composed of a first head section 22 and a second head section 23 and including a coating liquid supply slit 4 formed between the first head section 22 and the second head section 23 and extending in a longitudinal direction (shown by the arrow A in FIG. 3), opposite edges 6 and 7 extending from the top of the head 25 and cooperating to form an outlet 4*a*, and a longitudinally extending recess 28 formed in the first head section 23. As a feature of this embodiment, a plurality of adjusting means 30 are slidable in the longitudinal direction of the coating apparatus (shown by the arrow A in FIG. 3) and each include, at opposite ends, sliders 31 and 32 engaged with opposite sides (or opposing portions) 23*a* and 23*b* of the second head section 23.

The recess 28 of the head 25 is formed between the opposing portions 23*a* and 23*b* of the second head section 23. Also, dovetails or slider guide grooves 26 and 27 are formed in the opposing portions 23*a* and 23*b*, respectively and extend along the recess 28. Each of the adjusting means 30 comprises sliders 31 and 32 fitted within the guide grooves 26 and 27 and slidable in the longitudinal direction of the coating apparatus, a bolt 11 threaded into the slider 31, a square nut 12 threaded on the bolt 11, and a locking member 13 for locking the square nut 12 against the slider 32. The locking member 13 is secured to the slider 32 by two bolts 34 and 34. The bolt 11 has a front thread 11*a* and a rear thread 11*b*. The front thread 11*a* and the rear thread 11*b* are different in pitch from each other. Thus, the bolt 11 is in the form of a differential screw and enables high precision adjustment. As shown in FIGS. 3 and 4, the slider 32 is provided with a locking bolt 33. The locking bolt 33 has a front end which is pressed against the side 23*b* of the head 25 so as to lock the slider 32 in a desired position.

In the coating apparatus 21 of this embodiment, the adjusting means 30 are arranged at locations only where it is necessary to adjust or deform the edge 7. A required number of adjusting means 30 are slidably moved to separate a desired distance away from each other. The bolt 11 has a head 11*c* at its rear end. With the adjusting means 30 thus arranged, a pulling or compressive force is developed between the front thread 11*a* of the bolt 11 and the locking member 13 along the center axis F of the bolt 11 (see FIG. 1) when the head 11*c* is rotated by a suitable mean such as a wrench. These forces cause the sliders 31 and 32 to be moved away from or toward each other. As this occurs, the edge 7 is deformed so as to adjust a narrow clearance D, for example, about 0.1 to 3.0 mm, of the outlet 4*a* in the order of a few microns to a few hundred microns.

Although not shown, the coating apparatus 21 of this embodiment may be used to apply a coating liquid from the outlet 4*a* of the slit 4 directly onto the outer peripheral surface of a roll or the surface of an endless steel belt.

The coating apparatus 21 may also perform a post-coating metering method wherein the amount of a coating liquid as applied from the outlet 4*a* to a web W is measured before a coating layer C is deposited on the web W. In such a case, the clearance D of the outlet 4*a* should be widened, for example, about 3.0 to 20.0 mm. The thickness of the coating layer C in the longitudinal direction depends on a longitudinal clearance E formed between the web W and the edge 7. To this end, the bolts 11 are rotated to deform the edge 7 so as to adjust the clearance E after the adjusting means 30 have been moved to desired locations. As the edge 7 is deformed upon rotation of each adjusting means 30, the clearance D of the outlet 4*a* is changed in the order of a few microns to a few hundred microns. However, this change is negligible since the clearance D of the outlet 4*a* is sufficiently wide.

(Second embodiment)

Figure 5:
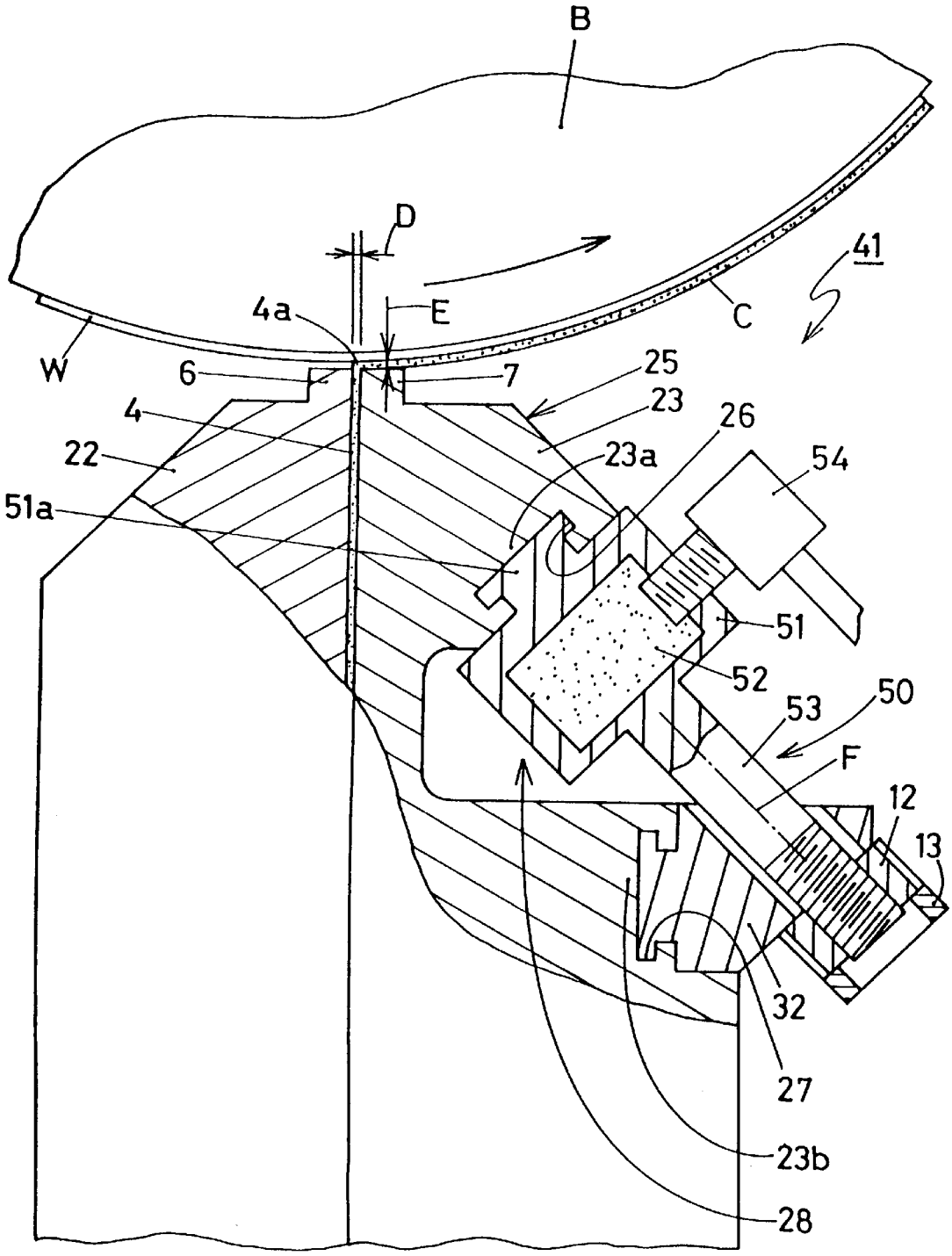
FIG. 5 is a side vie ma coating apparatus according to a second embodiment of the present invention with adjusting means shown in section.

FIG. 5 is a side view of a coating apparatus according to a second embodiment of the present invention with adjusting means shown in section. A coating apparatus 41 of this embodiment differs from that of the previous embodiment in that adjusting means 50 uses fluid pressure rather than the bolt 11 (see FIG. 2) so as to develop a pulling or compressive force.

As in the previous embodiment, the coating apparatus 41 of this embodiment comprises a split head 25 composed of a first head section 22 and a second head section 23 and including a coating liquid supply slit 4 formed between the first head section 22 and the second head section 23 and extending in a longitudinal direction, opposite edges 6 and 7 extending from the top of the head 25 and cooperating to form an outlet 4*a* , and a longitudinally extending recess 28 formed in the first head section 23. The recess 28 of the head 25 is formed between opposing portions 23*a* and 23*b* of the second head section 23. Also, dovetails or slider guide grooves 26 and 27 are formed in the opposing portions 23*a* and 23*b*, respectively and extend along the recess 28. A plurality of adjusting means 50 are movably fitted in the slider guide grooves 26 and 27.

Each of the adjusting means 50 comprises sliders 51 and 32 slidably fitted in and guided longitudinally of the slider guide grooves 26 and 27, a bolt 53 extending from the slider 51, a square nut 12 threaded on the bolt 53, and a locking member 13 for locking the square nut 12 against the slider 32. A fluid chamber 52 is formed within the slider 51. A fluid supply pipe 54 is connected to the slider 51 to supply a fluid to the fluid chamber 52 so as to control the pressure of the fluid within the fluid chamber 52. This pressure is used to develop a pulling or compressive force between a sliding portion 51*a* of the slider 51 and the locking member 13 along the center axis F of the bolt 53. These forces are used to deform the edge 7 so as to adjust the narrow clearance D of the outlet 4*a* or the clearance E between the web W and the edge 7 in the order of a few microns to a few hundred microns.

In order to control the pressure of the fluid within the fluid chamber 52 of the slider 51, a bolt or plunger may be inserted into the fluid chamber 52 and extended or retracted to control the pressure of the fluid. In such a case, the fluid chamber 52 must be sealed.

The locking member 13 of each adjusting means 50 is bolted as at 34 to the slider 32 as in the previous embodiment shown in FIG. 3. Also, the slider 32 is provided with a locking bolt 33. The locking bolt 33 is pressed against the portion 23*b* of the head 25 so as to lock the adjusting means in any desired position along the longitudinal recess.

In the coating apparatus 41 of this embodiment, the adjusting means 50 are arranged at any desired locations where it is necessary to adjustably deform the edge 7. A required number of adjusting means 50 are slidably moved in the longitudinal direction of the coating apparatus 41. With the adjusting means 50 thus arranged, the pressure of the fluid within the fluid chamber 52 is changed in a controllable manner to adjust the extent of deformation of the edge 7.

(Third embodiment)

Figure 6:
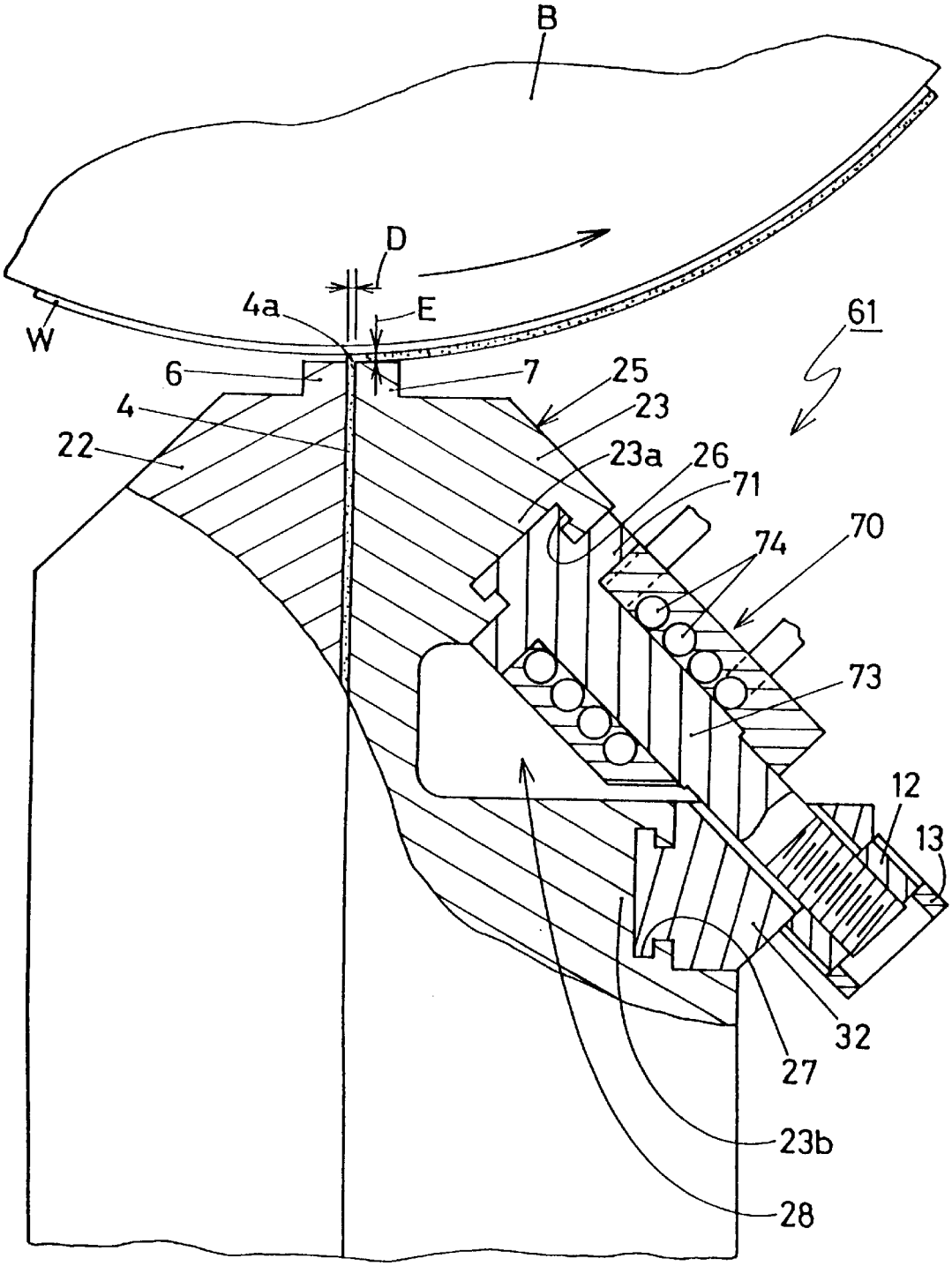
FIG. 6 is a side view of a coating apparatus according to a third embodiment of the present invention with adjusting means shown in section.

FIG. 6 is a side view of a coating apparatus according to a third embodiment of the present invention with adjusting means shown in section. A coating apparatus 61 of this embodiment differs from that of the first embodiment in that adjusting means 70 uses cooling/heating means rather than the bolt 11 (see FIG. 2) so as to develop a pulling or compressive force.

As in the first embodiment, the coating apparatus 61 of this embodiment comprises a split head 25 composed of a first head section 22 and a second head section 23 and including a coating liquid supply slit 4 formed between the first head section 22 and the second head section 23 and extending in a longitudinal direction, opposite edges 6 and 7 extending from the top of the head 25 and cooperating to form an outlet 4*a* , and a longitudinally extending recess 28 formed in the second head section 23. The recess 28 of the head 25 is formed between opposing portions 23*a* and 23*b* of the second head section 23. Also, dovetails or slider guide grooves 26 and 27 are formed in the opposing portions 23*a* and 23*b*, respectively and extend along the longitudinal recess 28. A plurality of adjusting means 70 are movably fitted in the slider guide grooves 26 and 27.

Each of the adjusting means 70 comprises sliders 71 and 32 slidably fitted in and guided longitudinally of the slider guide grooves 26 and 27, a bolt 73 extending from the slider 71, a square nut 12 threaded on the bolt 73, and a locking member 13 for locking the square nut 12 against the slider 32. A heating/cooling pipe 74 extends around the bolt 74. A heating medium has a suitable temperature and flows through the heating/cooling pipe 74. This causes the bolt 73 to be subjected to thermal stress. A change in the temperature of the heating medium causes a pulling or compressive force to be developed between the slider 71 and the locking member 13 along the center axis F of the bolt 53. These forces are used to adjust the narrow clearance D of the outlet 4*a* or the clearance E between the web W and the edge 7 in the order of a few microns to a few hundred microns.

Although not shown, a coil made of a shape memory alloy may be substituted for the bolt 73. A change in the temperature of the coil causes a pulling or compressive force to be developed to adjust the extent of deformation of the edge 7 and thus, the narrow clearance D of the outlet 4*a* or the clearance E between the web W and the edge 7 in the order of a few microns to a few hundred microns.

The locking member 13 of each adjusting means 70 is bolted as at 34 to the slider 32 as in the first embodiment shown in FIG. 3. Also, the slider 32 is provided with a locking bolt 33. The locking bolt 33 is pressed against the portion 23*b* of the head 25 so as to lock the adjusting means in any desired position along the longitudinal recess.

In the coating apparatus 61 of this embodiment, the adjusting means 70 are arranged at any desired locations where it is necessary to adjustably deform the edge 7. A required number of adjusting means 70 are slidably moved in the longitudinal direction of the coating apparatus 61. With the adjusting means 70 thus arranged, the edge 7 can be deformed to a desired extent by adjusting the temperature of a heating medium supplied.

Although not shown, an electric heater may be associated with the bolt 73. By adjusting the temperature of the electric heater, a pulling or compressive force can be developed in the bolt 73 or the coil made of a shape memory alloy.

(Fourth embodiment)

Figure 7:
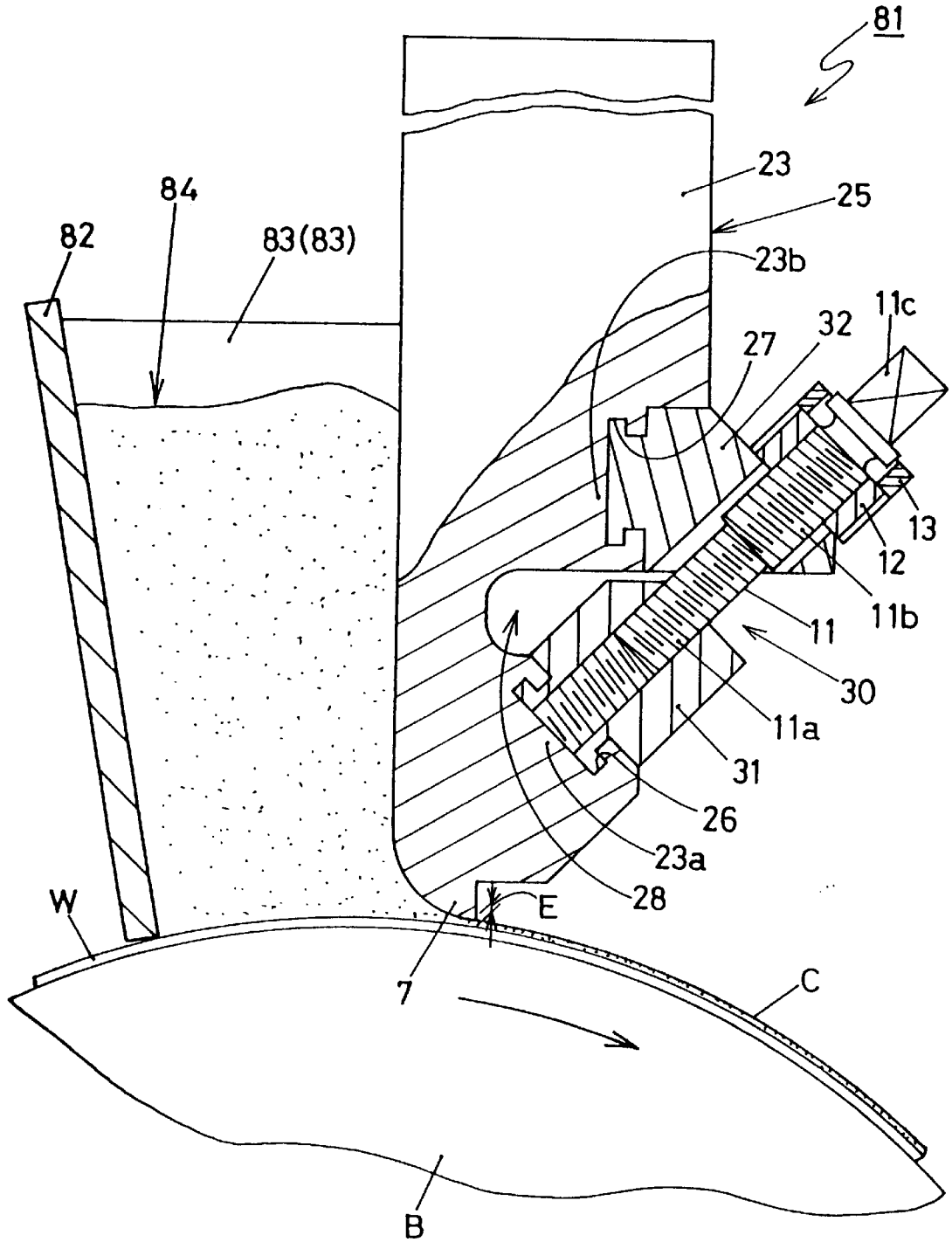
FIG. 7 is a side view of a coating apparatus according to a fourth embodiment of the present invention with adjusting means shown in section.
Figure 8:
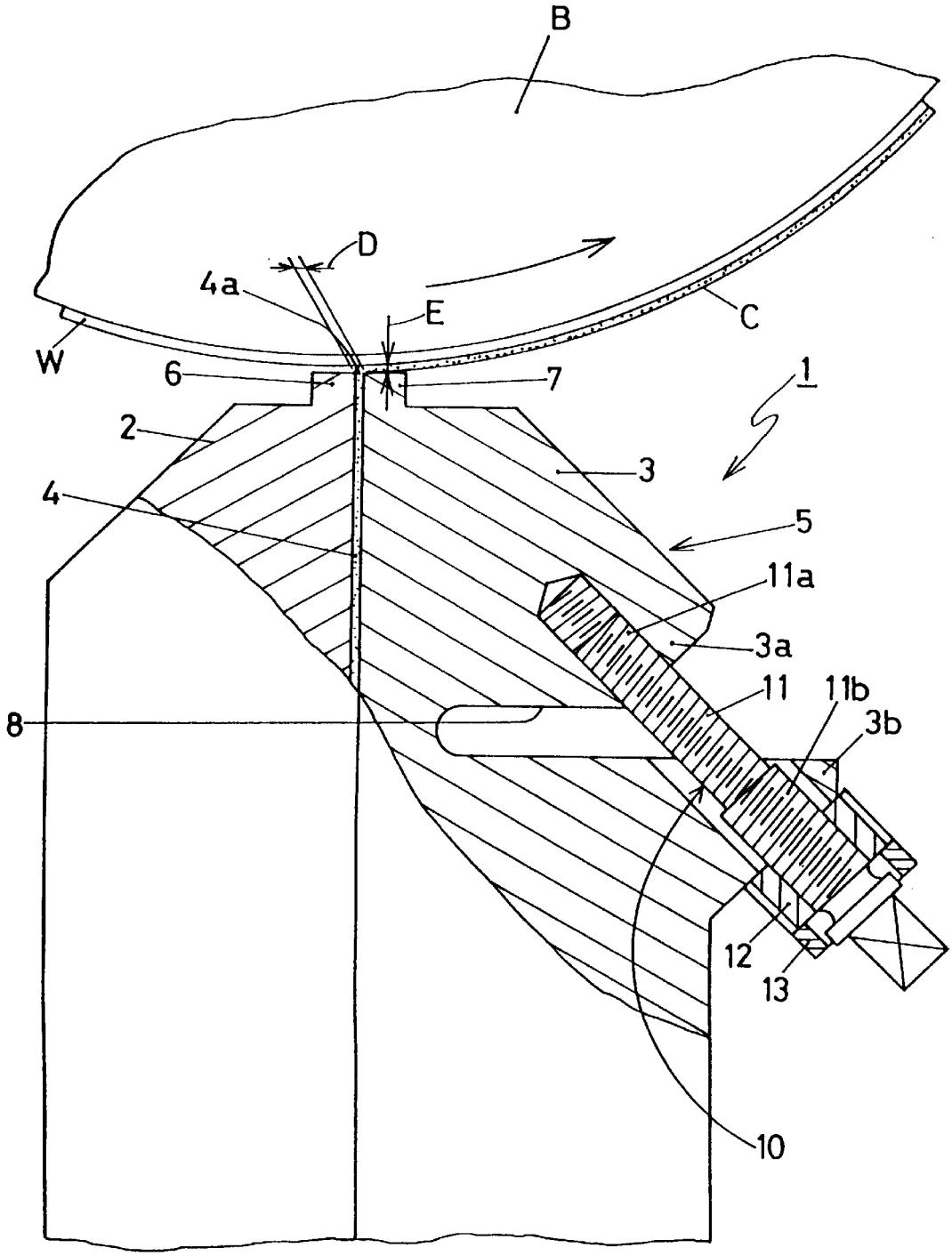
FIG. 8 is a left side view, partly in section, of a conventional coating apparatus.
Figure 9:
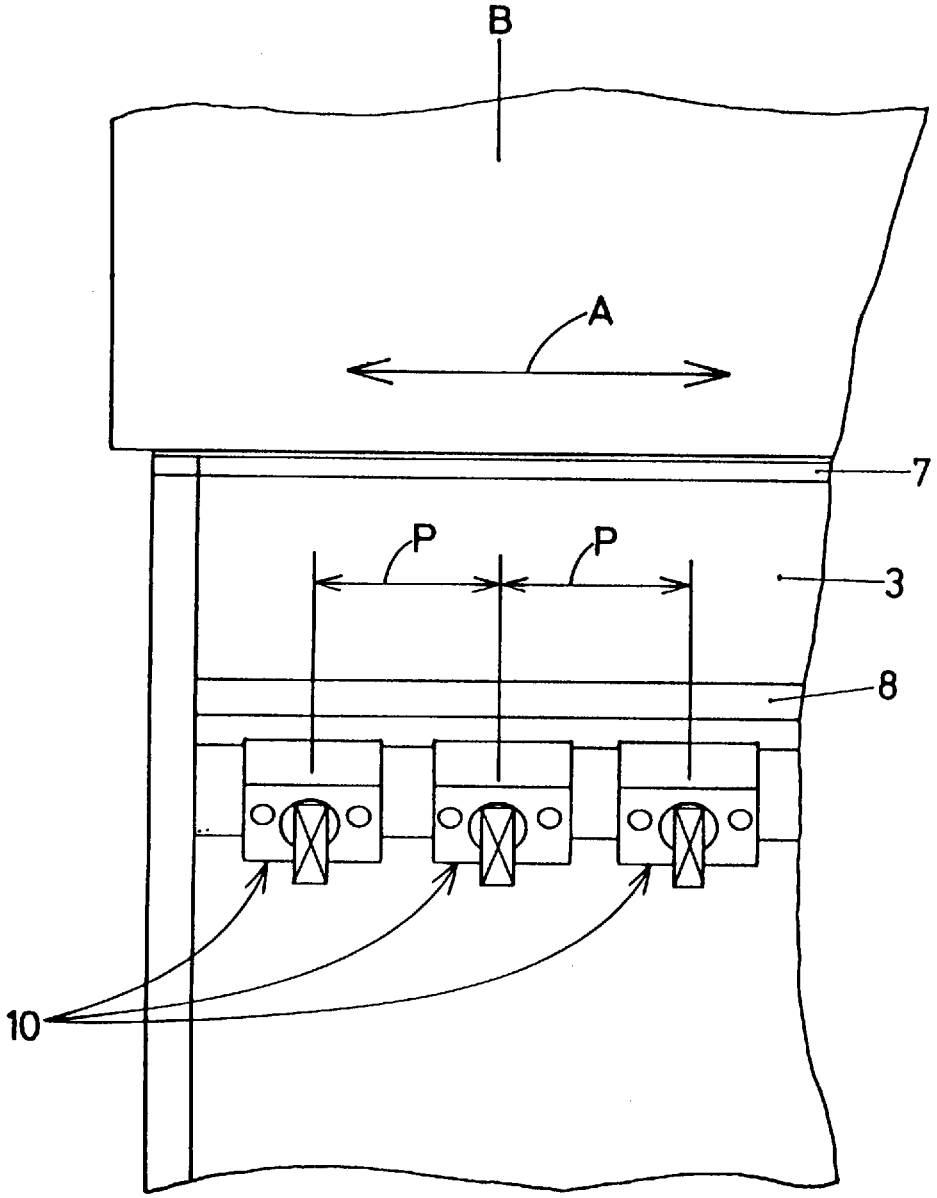
FIG. 9 is a partial front view, on a reduced scale, of the coating apparatus shown in FIG. 8.

FIG. 7 is a side view of a coating apparatus according to a fourth embodiment of the present invention with adjusting means shown in section. A coating apparatus 81 of this embodiment differs from that of the first embodiment in the sense that the edge 7 is located above a backing roll B, and a wall 82 extends longitudinally of the backing roll B and cooperates with side walls 83 and 83 to form a coating liquid reservoir 84. Adjusting means 30 is provided to adjust the clearance E between a web W and an edge 7. The adjusting means 30 is substantially identical in structure to that of the first embodiment and will not be described herein.

The present invention offers the following advantages.

According to the first feature of the present invention, a required number of adjusting means are arranged at any desired locations where it is necessary to adjust the extent of deformation of the edges. This arrangement minimizes the number of necessary adjusting means. Also, the location of adjustment can be freely changed along the longitudinal edges. Thus, there is no place where it is impossible to adjust the extent of deformation of the edges.

According to the second feature of the present invention, a required number of adjusting means are arranged at any desired locations where it is necessary to adjust the clearance between the edges. This arrangement minimizes the number of necessary adjusting means. Also, the location of adjustment can be freely changed along the longitudinal edges. Thus, there is no place where it is impossible to adjust the clearance between the edges.

According to the third and fourth features of the present invention, a required number of adjusting means are arranged at any desired locations where it is necessary to adjust the clearance between outer peripheral surface of the back up roll and the edges. This arrangement minimizes the number of necessary adjusting means. Also, the location of adjustment can be freely changed in the longitudinal direction of the back-up roll. Thus, there is no place where it is impossible to adjust the clearance between the outer peripheral surface of the back-up roll and the edges.

Although the present invention has been described with particular reference to preferred embodiments, it will be understood that many modifications and changes may be made without departing from the scope of the invention as defined by the appended claims.

What is claimed is:

1. A coating apparatus comprising:

a coating head having opposite edges which cooperate with each other to provide an outlet of a coating liquid supply slit, and opposing portions between which a longitudinal recess is formed; and a plurality of adjusting means each having opposite ends engaged with the opposing portions of said head, whereby a pulling or compressive force is developed between the opposite ends of the adjusting means so as to adjust a clearance between the edges, each of said adjusting means being movable in a longitudinal direction with the opposite ends of each of the adjusting means being engaged with the opposing portions of the head.

2. A coating apparatus comprising:

a back-up roll having an outer peripheral surface;

a coating head having edges between which an outlet of a coating liquid supply slit is formed, and opposing portions between which a longitudinal recess is formed; and a plurality of adjusting means each having opposite ends engaged with the opposing portions of said head, whereby a pulling or compressive force is developed between the opposite ends of the adjusting means so as to adjust a clearance between the outer peripheral surface of the back-up roll and the edges, each of said adjusting means being movable in a longitudinal direction with the opposite ends of each of the adjusting means being engaged with the opposing portions of the head.

3. A coating apparatus comprising:

a back-up roll having an outer peripheral surface;

a coating head having edges, and opposing portions between which a recess is formed and extends longitudinally of the back-up roll; and a plurality of adjusting means each having opposite ends engaged with the opposing portions of the head, whereby a pulling or compressive force is developed between the opposite ends of the adjusting means so as to adjust a clearance between the outer peripheral surface of the back-up roll and the edges, each of said adjusting means being movable in a longitudinal direction with the opposite ends of each of the adjusting means being engaged with the opposing portions of the head.

* * * * *